US008066215B2

(12) United States Patent
Demuth et al.

(10) Patent No.: US 8,066,215 B2
(45) Date of Patent: Nov. 29, 2011

(54) ROLLER PRESS WITH ANNULAR DISC

(75) Inventors: Lars Demuth, Holte (DK); Nicolaj Stenberg Balk Moller, Kobenhavn (DK)

(73) Assignee: FLSMIDTH A/S (DK)

( * ) Notice: Subject to any disclaimer, the term of this patent is extended or adjusted under 35 U.S.C. 154(b) by 145 days.

(21) Appl. No.: 12/667,148

(22) PCT Filed: Jul. 21, 2008

(86) PCT No.: PCT/EP2008/059544

§ 371 (c)(1), (2), (4) Date: Dec. 29, 2009

(87) PCT Pub. No.: WO2009/013276

PCT Pub. Date: Jan. 29, 2009

(65) Prior Publication Data

US 2010/0200686 A1 Aug. 12, 2010

(30) Foreign Application Priority Data

Jul. 25, 2007 (DK) ..... 2007 01083

(51) Int. Cl.

| | |
|---|---|
| ***B02C 1/10*** | (2006.01) |
| ***B02C 7/12*** | (2006.01) |
| ***B02C 13/28*** | (2006.01) |
| ***B02C 15/16*** | (2006.01) |

(52) U.S. Cl. ..... 241/294; 241/295

(58) Field of Classification Search ..... 241/294, 241/295

See application file for complete search history.

(56) References Cited

U.S. PATENT DOCUMENTS 4,854,508 A * 8/1989 Dicky ..... 241/236
6,389,862 B1 * 5/2002 Kusters ..... 72/197

* cited by examiner

*Primary Examiner* — Bena Miller
(74) *Attorney, Agent, or Firm* — Armstrong Teasdale LLP

(57) ABSTRACT

A roller press (1) is described for grinding particulate material such as cement raw materials, cement clinker and similar materials, the roller press having two oppositely rotating rollers (2, 3) with one roller being movably supported relative to the other roller and with the rollers (2, 3) forming between them a roller gap (4). A co-rotating annular disc is attached to one of the rollers (2), which subject to actuation by a number of springs (7), is movable in the direction of the roller axis and which, in the area around the roller gap (4,) extends over the end surface (3*a*) of the other roller. The annular disc is divided into a number of ring sectors (5) over its circumference, each individually biased by springs towards the end surface (3*a*) of the other roller (3). Hence, it is possible to maintain the grinding bed thickness at the ends of the rollers, thereby attaining a uniform pressure distribution across the rollers, as well as uniform grinding efficiency and uniform wear on the rollers.

7 Claims, 1 Drawing Sheet

ROLLER PRESS WITH ANNULAR DISC

This application is a filing under 35 U.S.C. 0371 of PCT/EP2008/059544 filed Jul. 21, 2008, which claims the benefit of Danish Application No. PA 2007 01083 filed Jul. 25, 2007, the disclosures of which are hereby incorporated by reference in their entirety.

The invention relates to a roller press for grinding of particulate material such as cement raw materials, cement clinker and similar materials.

More particularly the invention relates to a roller press which has two oppositely rotating rollers with a first roller being movably supported relative to the second roller so that the rollers form between them a roller gap, and a co-rotating annular disc, attached to an end of one of the rollers and extending over in the area around the roller gap and the end of the other roller, and which annular disc is movable towards the end surface of the other roller in the direction of the roller axis and under the action of a number of springs.

A roller press of the aforementioned kind is known from DE 40 37 816 A1, and may for example be used for grinding particulate material. Here, use is made of an annular disc to restrict and cover the roller gap at the ends of the rollers in order to limit the flow of material which is laterally discharged at the ends of the rollers during the operation of the roller press. The annular disc is spring-loaded so as to allow minor axial movements in instances where, for example, material particles which are hard and difficult-to-grind penetrate the area between the annular disc and the rollers, or in instances where one of the rollers is in an inclined position relative to the other roller. One disadvantage of the annular disc is that when, as a result of the pressure being exerted by the material, the annular disc is pushed away from the roller end, the gap which is formed extends to both sides of the roller gap of the roller press to a point opposite the roller gap. Hence a portion of the material to be ground will drop through the gap without being subjected to grinding. Also, another effect of the gap is that the grinding bed thickness is reduced at the ends of the roller gap since the material which was intended to form the grinding bed has dropped through the gap. This gives rise to an uneven distribution of pressure across the axial extension of the rollers, resulting in differences in grinding efficiency over the axial extension of the rollers. Another attendant disadvantage will be undesirable wear of the rollers.

It is the objective of the present invention to provide a roller press by means of which the aforementioned disadvantages are eliminated.

This is achieved by a roller press of the kind mentioned in the introduction which is characterized in that the annular disc is divided into a number of sectors over its circumference, each individually biased by one or more springs towards the end surface (3*a*) of the other roller (3).

As a result, it will be possible to maintain the grinding bed thickness at the ends of the rollers, thereby ensuring that the pressure is uniformly distributed across the rollers, resulting in uniform grinding efficiency and uniform wear on the rollers. This is attributable to the fact that during operation only the ring sector covering the roller gap will be subjected to the axial pressure exerted by the grinding bed, and, therefore, it is only this ring sector which is moved axially. The other ring sectors which are not affected by the pressure from the roller gap, but which will subsequently cover the roller gap, fit tightly against the roller, thereby ensuring that the material for forming the grinding bed at the ends of the roller gap is directed to the roller gap.

Preferably, the ring sectors have end stops for the axial movement of the ring sectors in the direction towards the roller. In principle, the end stops may be made up of any suitable means effectively restricting the axial movement of the ring sector in the direction towards the roller. In a simple embodiment an end stop may comprise a number of studs having a certain axial extension and being attached either to the end of the roller or to the ring sector. To allow adjustment of the migration of the ring sector and its minimum distance relative to the end of the roller, it is preferred that the axial extension of the end stop is adjustable. The end stop can also be used to pre-tension the springs. In a special preferred embodiment of the invention, the end stop is made up of a number of adjustable screws which are fitted in through-going threaded holes in the ring sector.

It is preferred that the ring sectors are fitted on the non-movable roller since in a situation where the movable roller is distorted there would otherwise be a risk of collision between the ring sectors and the roller. Any distortion during operation of the movable roller would mainly be ascribable to axial segregation of the material in the feed shaft. Such segregation entails that fine material may be present at one end of the roller gap while coarse material is present at the other end of the roller gap. This will lead to an uneven grinding bed thickness along the roller gap, resulting in a distortion of the movable roller. Where the grinding bed thickness is small, the end of the movable roller will move across the stationary roller. If the sectors of the annular disc are fitted on the movable roller, there is a risk of collision between the ring sector, which is located off the roller gap at the end of the roller gap where the grinding bed thickness is small, and the stationary roller, due to the fact that the axial pressure from the grinding bed which is required to actuate the springs in the ring sector will be quite small. If, instead, the sectors of the annular disc are fitted on the stationary roller, there is no risk of collision between the movable roller and the ring sector which is located off the roller gap at the end of the roller gap where the grinding bed thickness is small, since it will now be possible for the end of the movable roller to move freely across the stationary roller. At the other end of the roller gap, where the grinding bed thickness is substantial, the axial pressure from the grinding bed will actuate the springs in the ring sector using a force which is so strong that the springs will be compressed to such an extent that the sectors of the annular disc are moved away to avert a potential collision with the end of the movable roller now beyond the end of the stationary roller.

One example of a roller press according to the invention will now be described in further details with reference to the accompanying diagrammatic drawings, in which.

Figure 1:
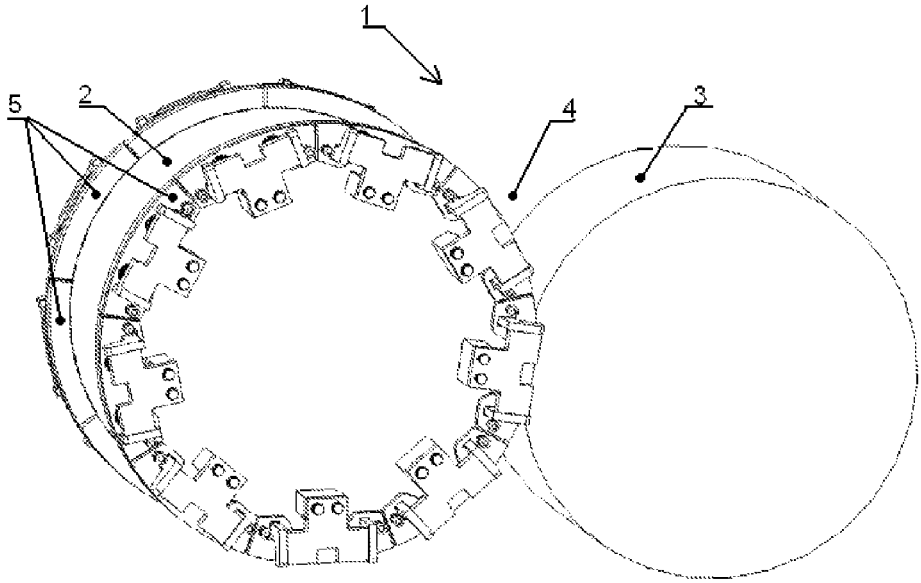
FIG. 1 shows a section of a roller press.

FIG. 1 shows a roller press 1 which comprises two oppositely rotating rollers 2, 3, where one roller is movably supported relative to the second roller, with the rollers 2, 3 forming between them a roller gap 4. On both ends of one of the rollers 2 multiple co-rotating ring sectors 5 are symmetrically fitted around the axis of the roller 2.

Figure 2:
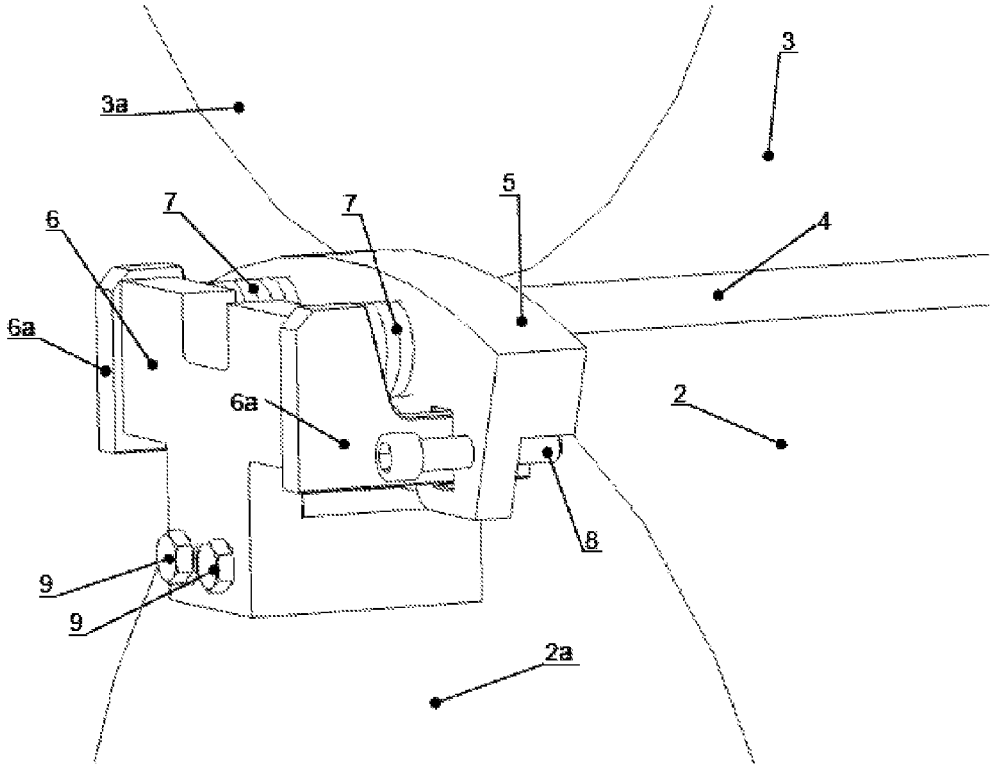
FIG. 2 shows a sectional view of the roller press illustrated in FIG. 1.

FIG. 2 shows the two oppositely rotating rollers 2, 3 and a single co-rotating ring sector 5 which, subject to actuation by a number of springs 7, is mounted for movement in the direction of the roller axis, and extends over the end surface 3*a* of the second roller 3 in the area around the roller gap 4. Via a frame or mounting structure 6, the ring sector 5 is attached to the roller end 2*a*, for example by means of screws 9, and the springs 7 lie true against the frame structure 6 and the ring sector 5. The frame structure 6 is equipped with arms 6*a* to control the movements of the ring sector 5. End stops 8, in the form of, for example, one or more bolts, are fitted in threaded holes in the ring sector 5 on both sides of the latter and engage the end surface 2*a* of the roller 2. Adjustment of the end stops 8 will cause the ring sector 5 to move axially, thereby attaining the desired position of the ring sector 5.

The invention claimed is:

1. A roller press for grinding of particulate material such as cement raw materials, cement clinker and similar materials, said roller press comprising:

first and second oppositely rotating rollers, one of said first and second rollers mounted so as to be movable relative to the other of the first and second rollers, said rollers forming a roller gap therebetween;

a plurality of springs; and a co-rotating annular disc, attached to one of said first and second rollers, said annular disc subject to actuation by said springs and mounted so as to be movable in the direction of a roller axis, said annular disc extending over an end surface the other of said first and second said rollers proximate the roller gap, wherein said annular disc comprises a number of ring sectors around its circumference, said ring sectors individually biased by one or more of said springs towards the end surface.

2. A roller press according to claim 1 wherein each said ring sector comprises an end stop to limit the axial movement of said ring sector in the direction towards the end surface.

3. A roller press according to claim 2 wherein said end stop comprises a number of studs attached to said ring sector.

4. A roller press according to claim 2 wherein said end stop is adjustable.

5. A roller press according to claim 2 wherein said end stop comprises a number of adjustable screws fitted within through-going threaded holes formed in said ring sector.

6. A roller press according to claim 1 wherein said ring sectors are fitted on the second of said rollers.

7. A roller press according to claim 6 wherein the second of said rollers is unmovable.

* * * * *